US005226280A

United States Patent [19]

Scherer et al.

[11] Patent Number: 5,226,280

[45] Date of Patent: Jul. 13, 1993

[54] APPARATUS FOR PLACING CORNER PROTECTORS ONTO PALLETIZED LOADS

[75] Inventors: Philip G. Scherer, Fort Lauderdale; Werner K. Diehl, Coral Springs, both of Fla.

[73] Assignee: Mima Inc., Boca Raton, Fla.

[21] Appl. No.: 855,263

[22] Filed: Mar. 23, 1992

[51] Int. Cl.[5] ..... B65B 61/00

[52] U.S. Cl. ..... 53/139.7; 414/224; 414/225; 414/798.9; 221/211; 221/252; 29/809

[58] Field of Search ..... 414/224, 225, 752, 744.3, 414/744.5, 744.6, 744.7, 798.9; 29/809; 53/137.9; 221/211, 232, 279

[56] References Cited

U.S. PATENT DOCUMENTS

| | | | |
|---|---|---|---|
| 1,418,153 | 5/1922 | Lorber | 221/279 |
| 3,378,987 | 4/1968 | Lems | 53/139.7 X |
| 4,934,123 | 6/1990 | Salzsauler | 53/399 |
| 4,938,008 | 7/1990 | Salzsauler | 53/556 |

FOREIGN PATENT DOCUMENTS

| | | | |
|---|---|---|---|
| 2431153 | 1/1976 | Fed. Rep. of Germany | 53/139.7 |
| 853775 | 4/1987 | Finland . | |
| 1210491 | 10/1970 | United Kingdom | 221/211 |

*Primary Examiner*—David A. Bucci
*Assistant Examiner*—Donald W. Underwood
*Attorney, Agent, or Firm*—Dressler, Goldsmith, Shore, Sutker & Milnamow, Ltd.

[57] ABSTRACT

An apparatus for placing corner protectors having elongate panels meeting at right angles onto vertical corners of pallet loads having vertical sides defining vertical corner comprises a magazine to hold a supply of the corner protectors and mechanisms for removing one corner protector from the magazine, transferring the corner protector to a position where one of its panels is disposed in close proximity to a vertical side of such a load, and displacing the corner protector until its other panel engages another side at the same corner of the load. In the magazine, the corner protectors extend vertically and are nested within one another. Also, the corner protectors are guided forwardly along a supporting chute. A wheeled carriage having an upright member is mounted operatively in the chute and prevents the corner protectors from tipping backwards.

10 Claims, 6 Drawing Sheets

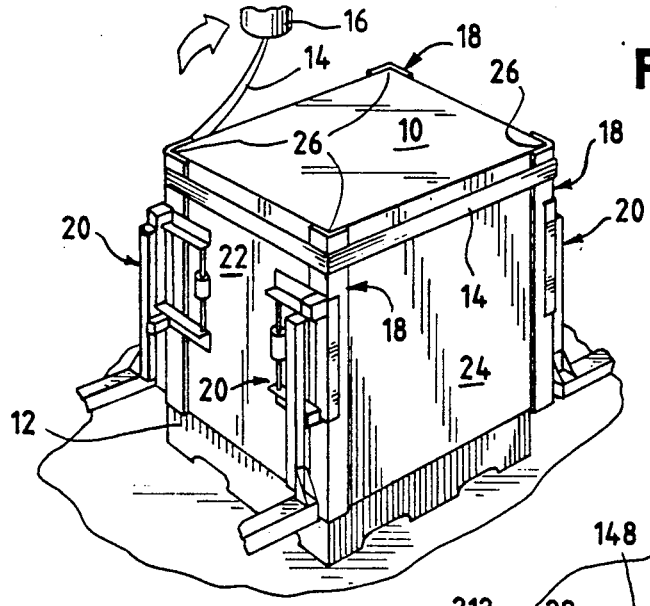
Fig. 1
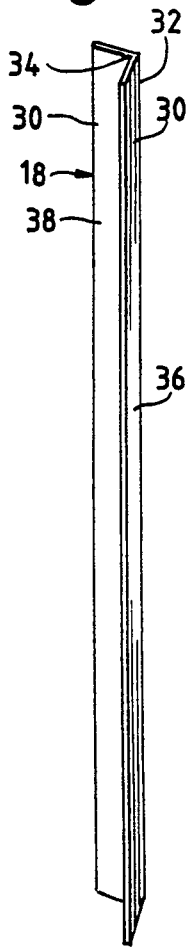
Fig. 2
Fig. 3
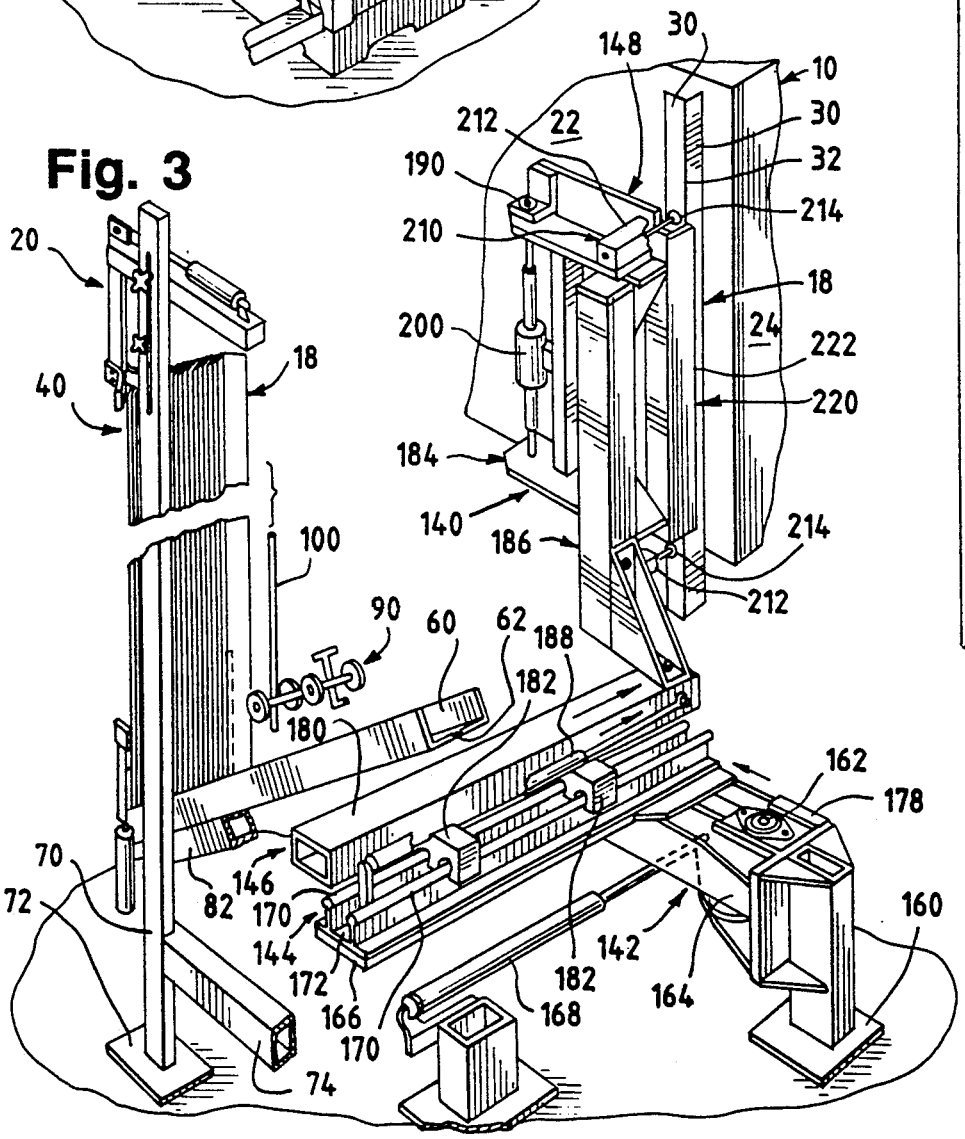

Fig. 4
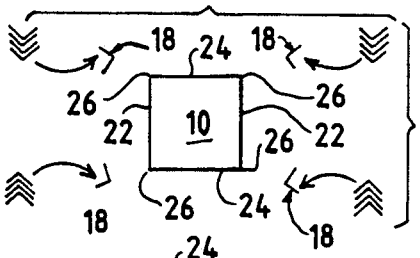
Fig. 6
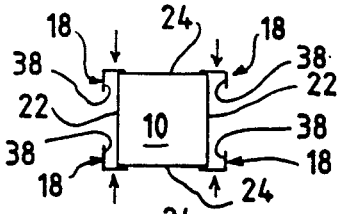
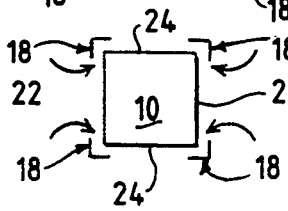
Fig. 5
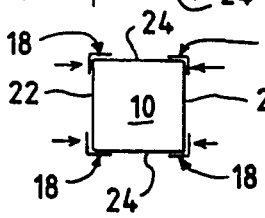
Fig. 7
Fig. 8
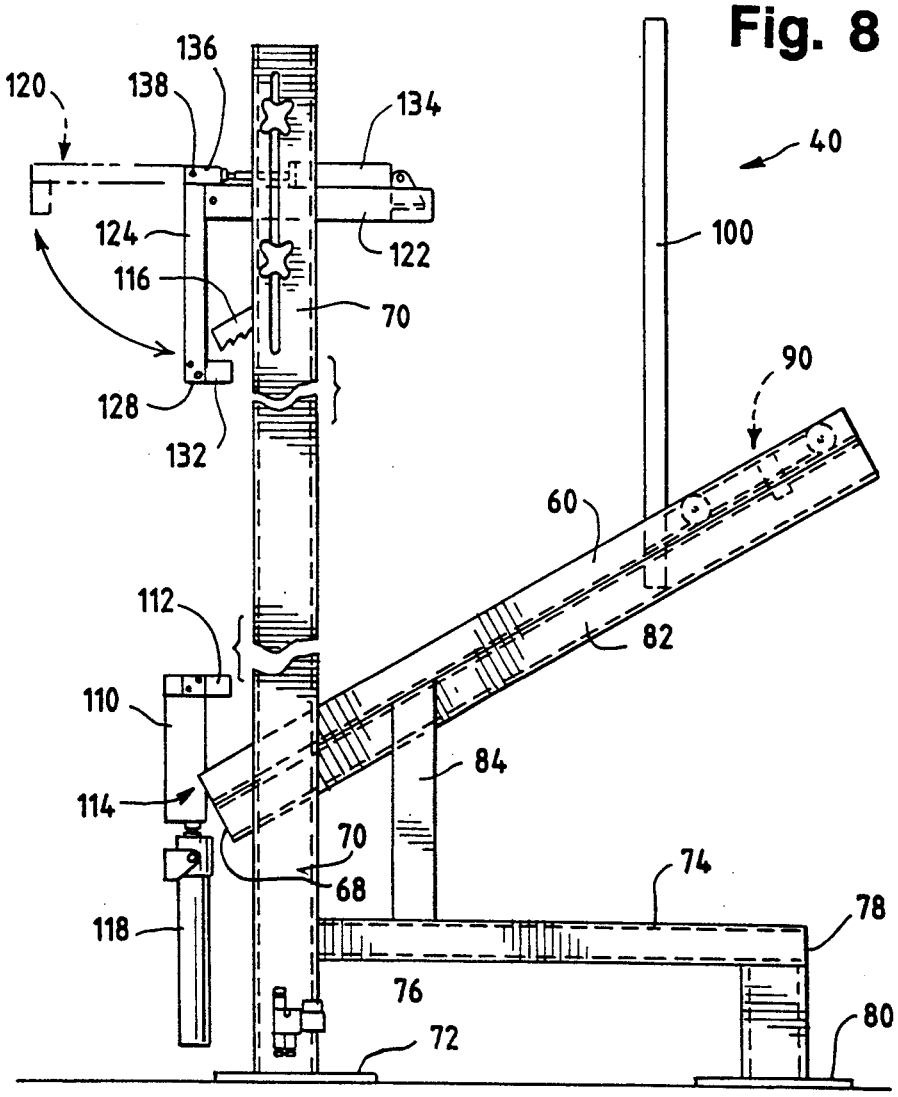

APPARATUS FOR PLACING CORNER PROTECTORS ONTO PALLETIZED LOADS

TECHNICAL FIELD OF THE INVENTION

This apparatus pertains to a novel apparatus for placing corner protectors onto vertical corners of palletized loads to be then wrapped or strapped. The apparatus accommodates palletized loads within a range of varying dimensions and minimizes manual handling of the corner protectors.

BACKGROUND OF THE INVENTION

Commonly, before a load is wrapped with stretch film or strapped with steel strapping or oriented polymeric strapping, corner protectors of a type having two elongate panels meeting generally at a right angle are placed onto the load. The corner protectors are placed so as to protect the vertical corners of the load against being crushed by the film or strapping.

Such corner protectors, made of laminated paper, are available commercially from Shippers Paper Products Company (a unit of Illinois Tool Works Inc.) of Cincinnati, Ohio, under its ANGLEBOARD trademark.

It would be highly desirable to have an apparatus that would automate placing the corner protectors onto palletized loads to be then wrapped or strapped and that would accommodate palletized loads within a range of varying dimensions.

SUMMARY OF THE INVENTION

This invention provides a novel apparatus for placing corner protectors onto palletized loads having vertical sides meeting generally at right angles to define vertical corners. After the corner protectors have been placed onto the vertical corners by the novel apparatus, the loads are ready to be then wrapped with stretch film or strapped with steel strapping or oriented polymeric strapping. Broadly, the apparatus comprises a magazine adapted to hold the supply of the corner protectors and mechanisms for removing one corner protector from the magazine, transferring the corner protector to a position of initial engagement, and displacing the corner protector from such position.

In the position of initial engagement, the inside surface of one panel of the corner panel is disposed in close proximity to one vertical side of the load. Moreover, in such position, the inside surface of the other panel of the corner protector faces the vertical side meeting the vertical side engaged thereby. The corner protector is displaced from such position to such extent as may be then necessary to cause the inside surface of the other panel to engage the vertical side faced by the other panel. The apparatus is useful with palletized loads within a range of varying dimensions.

Preferably, the magazine is adapted to hold a supply of corner protectors extending vertically and being nested within one another. Preferably, moreover, the magazine comprises a chute inclined forwardly and downwardly toward an outlet end. The chute is adapted to support the supply of nested corner protectors with their outside corners facing forwardly and to guide the corner protectors supported thereby forwardly toward the outlet end of the chute. The magazine comprises a mechanism for pressing against an endmost one of the corner protectors supported by the chute so as to prevent the corner protectors supported thereby from tipping backwardly.

The pressing mechanism may comprise a wheeled carriage disposed movably within the chute. The wheeled carriage is adapted to move downwardly toward the corner protectors supported by the chute. The wheeled carriage comprises an upright member adapted to press against the endmost one of the corner protectors supported thereby.

Preferably, the magazine comprises a mechanism for elevating the corner protector nearest to the outlet end of the chute to an elevated position where the elevated corner protector is removed from the magazine.

In a preferred form, the apparatus comprises a mechanism engageable releasably with the outside surface of such one panel for gripping the corner protector as the corner protector is removed, transferred, and displaced. The gripping mechanism may comprise a pair of vacuum cups engageable releasably with the outside surface of such one panel of the corner protector at vertically spaced locations.

These and other objects, features, and advantages of this invention are evident from the following description of two embodiments of this invention with reference to the accompanying drawings.

BRIEF DESCRIPTION OF THE DRAWINGS

FIG. 1 is a fragmentary, perspective of a palletized load having corner protectors placed onto its vertical corners by apparatus according to a first embodiment of this invention. Three such apparatus are shown fragmentarily, a fourth being hidden by the palletized load. A machine wrapping the palletized load with a band of stretch film is shown fragmentarily.

FIG. 2 is a perspective view of one such corner protector.

FIG. 3 is a fragmentary, perspective view of one such apparatus in a "right-hand" configuration according to the first embodiment noted above.

FIGS. 4, 5, 6, and 7 are sequential, schematic views showing four stages in placing the corner protectors on the palletized load by means of four such apparatus.

FIG. 8 is an elevational view of a magazine apart from other elements of the apparatus of FIG. 3.

DETAILED DESCRIPTION OF ILLUSTRATED EMBODIMENTS

Figure 13:
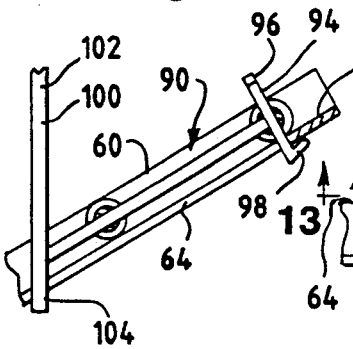
FIG. 13 is a fragmentary, plan view of a chute apart from other elements of the magazine of FIG. 8.
Figure 12:
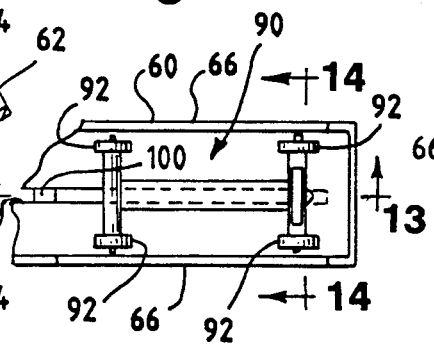
FIG. 12 is a fragmentary, elevational view of a wheeled cart apart from other elements of the magazine of FIG. 8.
Figure 14:
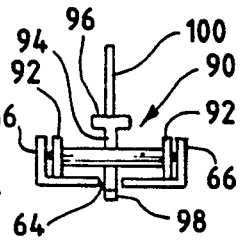
FIG. 14 is an end view of the chute supporting the wheeled cart.

As shown in FIG. 1, a load 10 resting on a pallet 12 is being wrapped with a band 14 of stretch film by a wrapping machine 16, after corner protectors 18 have been applied to vertical corners of the load 10 by four similar apparatus 20, each constituting a first embodiment of this invention.

The palletized load 10, which may comprise stacked cartons (not shown) or other items, conforms generally to a rectangular solid. Thus, the load 10 has two pairs of opposed, vertical sides 22, 24, which meet generally at right angles to define vertical corners 26 of the load 10.

The wrapping machine 16, which is shown fragmentarily in FIG. 1, may be of a type exemplified in Salzsauler U.S. Pat. Nos. 4,934,123, and 4,938,008. Such wrapping machines are available from ITW-Mima (a division of Illinois Tool Works Inc.) of Boca Raton, Fla., under its COBRA trademark.

As shown in FIG. 2, each corner protector 18 has two elongate panels 30 meeting generally at a right angle to define an outside corner 32 and an inside corner 34. Each elongate panel 30 has an outside surface 36 and an inside surface 38. Each corner protector 18 is cut to a length equal approximately to the height of the load 10 at one of the vertical corners 26. The corner protectors 18 protect the vertical corners 26 against being crushed by the band 14 of stretch film as the load 10 is wrapped by the wrapping machine 16.

Figure 18:
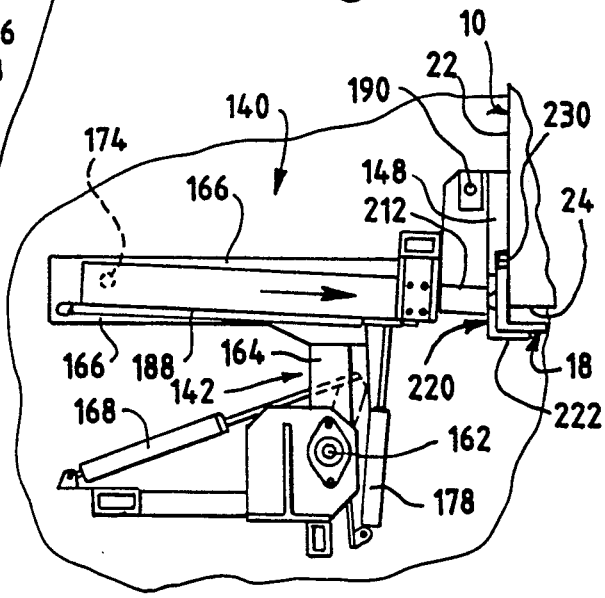
Figure 20:
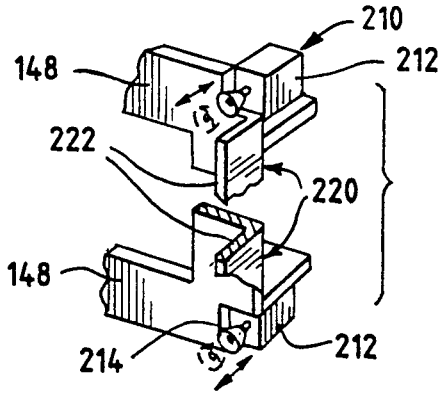
FIG. 20 is a fragmentary, perspective detail of a gripping mechanism of one such apparatus in a "left-hand" configuration according to the first embodiment of this invention.
Figure 19:
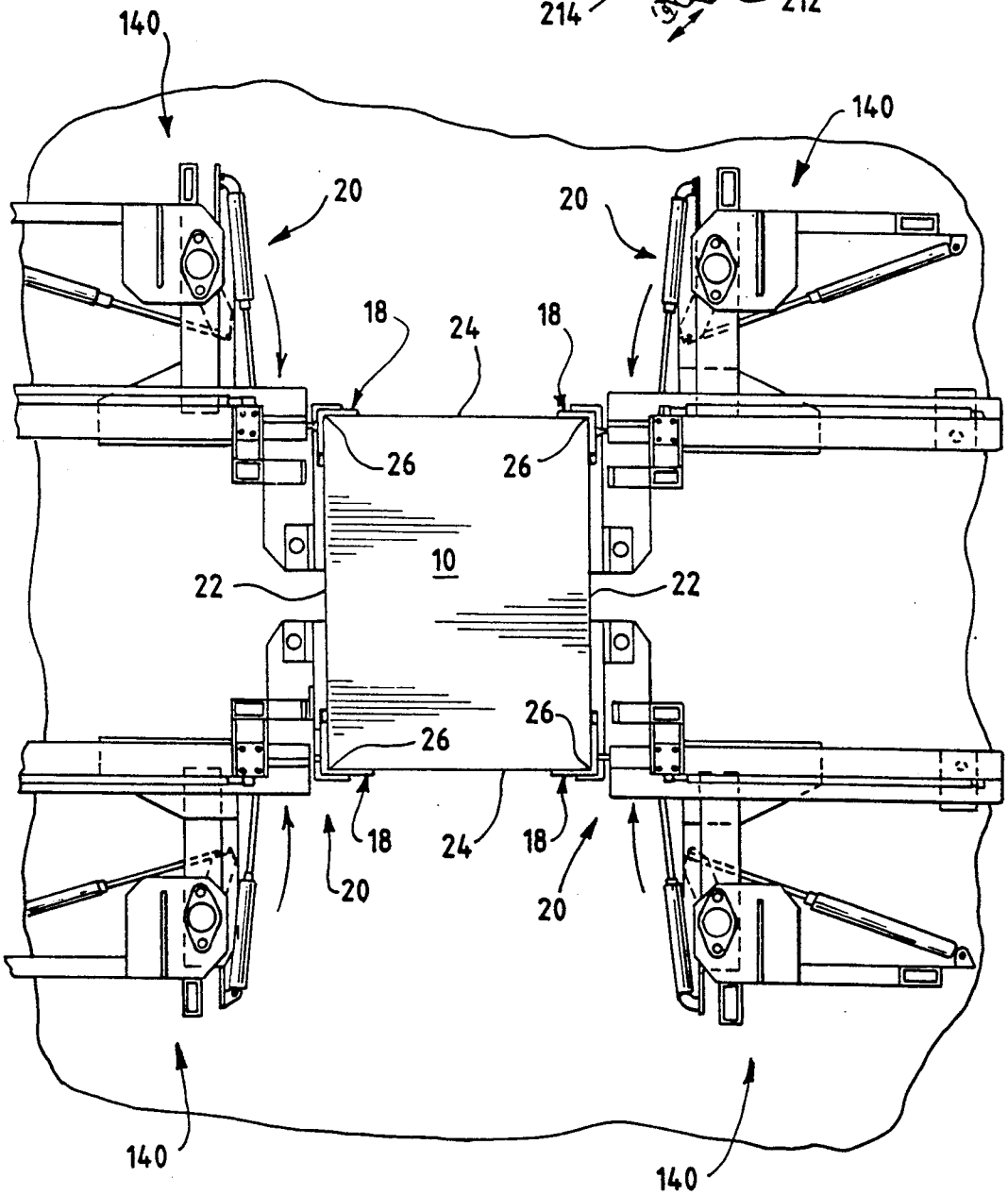
FIG. 19 is a fragmentary plan view showing each of the four apparatus in a further stage in their operation.

As shown fragmentarily in FIG. 19, four such apparatus 20 are provided, two in a "right-hand" configuration and two in a "left-hand" configuration. The apparatus 20 at the lower left and the upper right in FIG. 16 are of the "right-hand" configuration. The apparatus 20 at the upper left and the lower right in FIG. 16 are of the "left-hand" configuration. One of the apparatus 20 in the "right-hand" configuration is shown in greater detail in FIG. 3, FIGS. 15 through 18, and other views.

As shown in FIG. 3, the apparatus 20 comprises a magazine 40 adapted to hold a supply of the corner protectors 18 and mechanisms to be later described for removing one corner protector 18 from the magazine 40, transferring the corner protector 18 to a position of initial engagement, and displacing the corner protector 18 from t he position of initial engagement into a position of final engagement. These successive steps are illustrated diagrammatically in FIGS. 4, 5, 6, and 7.

In the position of initial engagement, the inside surface 38 of one panel 30 of the corner protector 18 is disposed in close proximity to one vertical side 24 of the load 10 and is generally parallel to such side 24. Moreover, in such position, the inside surface 38 of the other panel 30 of the corner protector 18 faces the vertical side 26 meeting the vertical side 24 engaged thereby. When the corner protector 18 is displaced from the position of initial engagement into the position of final engagement, the corner protector 18 is displaced to such extent as may be then necessary to cause the inside surface 38 of the panel 30 facing such side 26 to engage such side 26, generally in surface-to-surface engagement.

The magazine 40 comprises an elongate hopper or chute 60, which has a lower wall 62 with an elongate slot 64 and two side walls 66, and which is inclined forwardly and downwardly toward an outlet end 68. The chute 60 is affixed to a post 70, which is mounted on a pedestal 72, and which is counterbalanced by a horizontal beam 74 extending backwardly from the post 70. The beam 74 has a front end 76 affixed to the post 70 and a back end 78 (see FIG. 8) mounted on a pedestal 80. The chute 60 is supported by a beam 82 inclined similarly, affixed to the post 70, and braced by a brace 84 extending vertically between the beam 74 and the beam 82.

As shown in FIGS. 3, 12, 13, and 14, the magazine 40 comprises a wheeled carriage 90 having four wheels 92 and being disposed movably within the chute 60, between the side walls 66. The carriage 90 has a centering guide 94 with an upper handle 96 and a lower hook 98. The centering guide 94 extends downwardly through the elongate slot 64 to help in centering the carriage 90 between the side walls 66 and in guiding the carriage 90 along the chute 60. When it is desired to add more corner protectors 18, the handle 96 is convenient for moving the carriage 90 backwardly and upwardly along the chute 60. The hook 98 is adapted to fit under the lower wall 62, at the upper extremity of the elongate slot 64, with a frictional fit enabling the carriage 90 to be temporarily held at such extremity while more corner protectors 18 are being added.

The wheeled carriage 90 carries an upright member 100 having a substantial height compared to the corner protectors 18. An upper portion 102 of the upright member 100 is adapted to press against the inside corner 34 of the endmost one of the corner protectors 18 supported by the chute 60, so as to prevent the corner protectors 18 supported thereby from tipping backwardly, and so as to feed the corner protectors 18 forwardly along the chute 60. A lower portion 104 of the upright member 100 extends downwardly through the elongate slot 64 to help in centering the carriage 90 between the side walls 66 and in guiding the carriage 90 along the chute 60.

Figure 9:
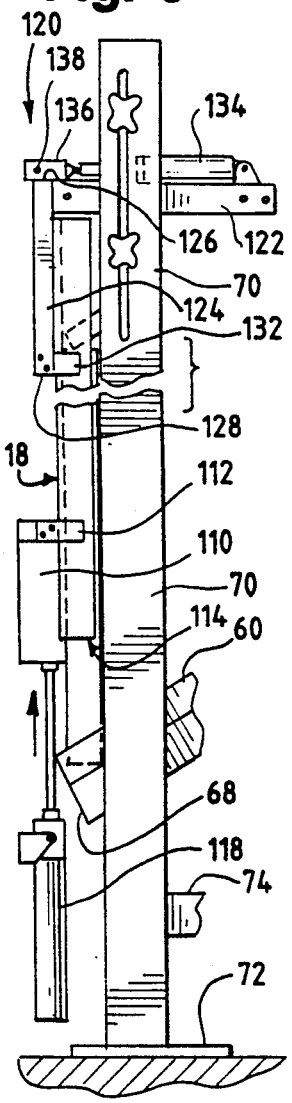
FIGS. 9, 10, and 11 are fragmentary, elevational views showing the magazine of FIG. 8 in three stages of its operation.
Figure 10:
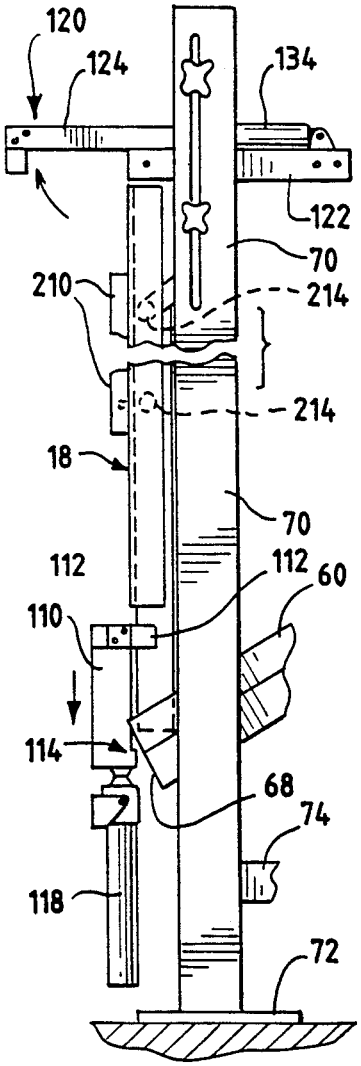
Figure 11:
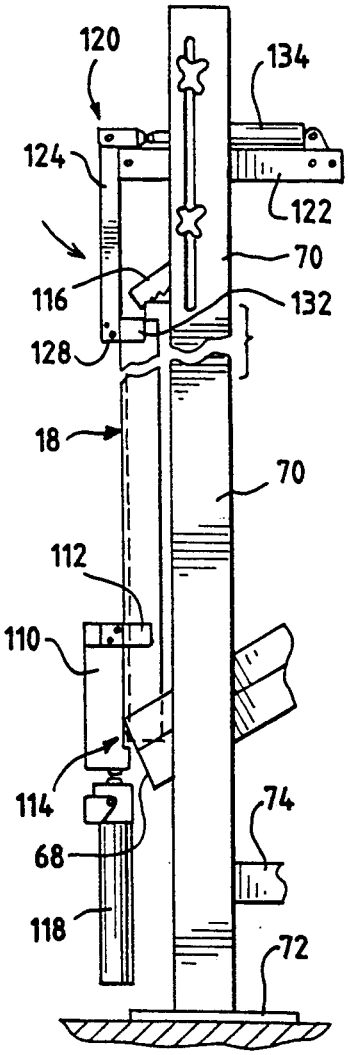

As shown in FIGS. 9, 10, and 11, the magazine 40 comprises an escapement 110, which is mounted to the post 70 so as to be vertically movable between a lower position and an upper position. A Y-shaped retainer 112 is mounted to the escapement 110 for conjoint movement with the escapement 110. The escapement 110 has a lower, hook-shaped portion 114, which is arranged to engage the lower end of the corner protector 18 nearest to the outlet end 68 of the chute 60 and to elevate such corner protector 18 to an elevated position (see FIG. 9) where such corner protector 18 is removed from the magazine 40 in a manner toothed edge (see FIGS. 8 and 11) is mounted to the post 70, above the next corner protectors 18, so as to prevent more than one corner protector 18 from being elevated at any one time. A double-acting, pneumatic, piston-cylinder mechanism 118 mounted operatively on the post 70 is operable to move the escapement 110 between its lower position and its upper position.

Furthermore, the magazine 40 comprises a retaining mechanism 120, which is mounted operatively on a bracket 122 secured to the post 70 in an elevated position. The position of the bracket 122 relative to the post 70 is adjustable, within a limited range of vertical adjustment so as to accommodate corner protectors of different lengths. The retaining mechanism 120 comprises an arm 124 having a proximal end 126 and a distal end 128 and being mounted pivotably on the bracket 122, via a pivot pin 138, so as to be pivotable between a vertical position and a horizontal position. In FIG. 8, the arm 124 is shown in the vertical position in full lines and in the horizontal position in dashed lines. A Y-shaped retainer 132 is affixed to the distal end 128 of the arm 124.

Moreover, the retaining mechanism 120 comprises a double-acting, pneumatic, piston-cylinder mechanism 134, which is mounted operatively on the bracket 122. The mechanism 120 is connected to the arm 124 by a link 136, which is connected to the proximal end 126 by a pivot pin 138, and is operable to pivot the arm 124 between the vertical and horizontal positions.

In the vertical position of the arm 124, the retainer 132 engages the corner protector 18 nearest to the outlet end 68 of the chute 60, so as to retain the corner protectors 18 supported by the chute 60. The retaining mechanism 120 is arranged to pivot the arm 124 from the vertical position into the horizontal position, but only when the escapement 110 has elevated the corner protector 18 nearest to the outlet end 68 of the chute 60 to the elevated position, so as to permit such corner protector 18 to be then gripped (before its removal from the magazine 40) in a manner to be later described. The escapement 110 and the retainer 112 are arranged to return to the lower position after such corner protector 18 has been gripped and before such corner protector 18 is removed from the magazine 40. The retaining mechanism 120 is arranged to pivot the arm 124 from the horizontal position into the vertical position after such corner protector 18 has been removed.

Figure 15:
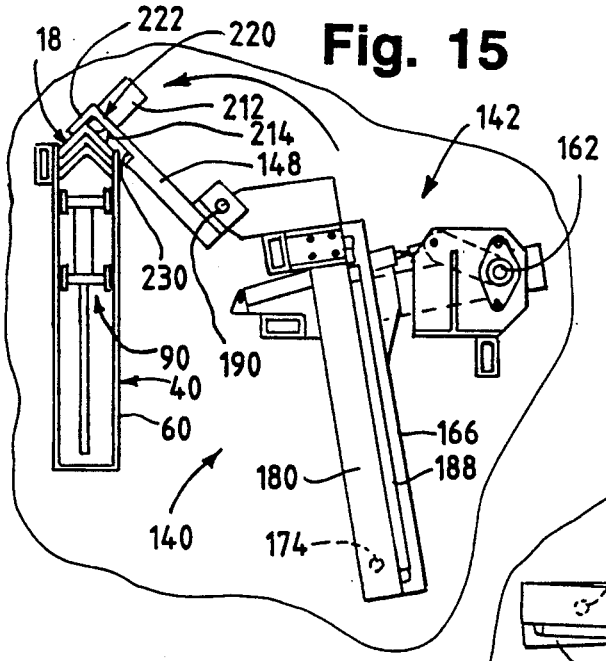
FIGS. 15, 16, 17, and 18 are sequential, fragmentary, plan views showing the apparatus of FIG. 3 in four stages of its operation.
Figure 17:
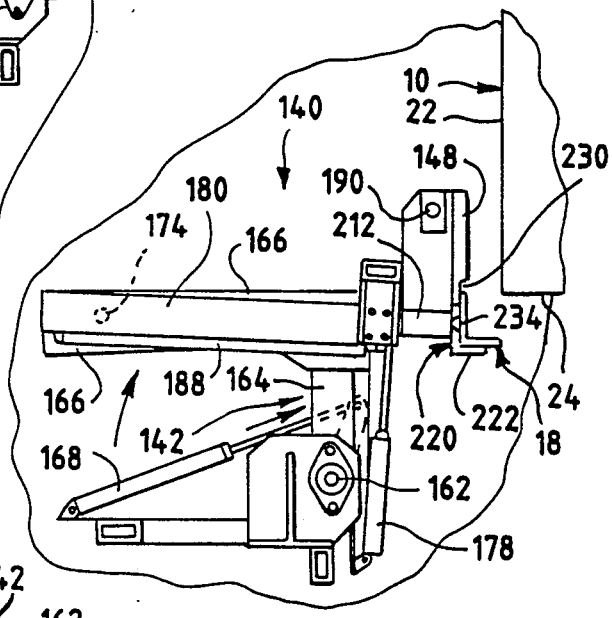
Figure 16:
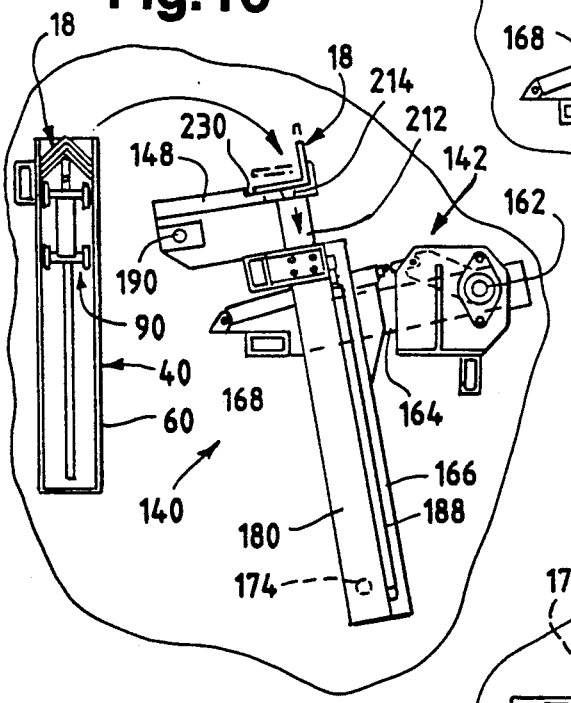

As shown in FIGS. 3, 15 through 19, and 20, the apparatus 20 comprises mechanisms 14 for removing one corner protector 18 from the magazine 40, transferring the corner protector 18 to the position of initial engagement, and displacing the corner protector 18 from the position of initial engagement to the position of final engagement. The corner protector 18 to be thus removed is the corner protector 18 nearest to the outlet end 68 of the magazine 40. The apparatus 20 is shown in FIG. 15 as removing the corner protector 18 from the magazine 40. The apparatus 20 is shown in FIGS. 16, 17, and 18 in successive stages in transferring the corner protector 18 to the position of final engagement. Each of the apparatus 20 is shown in FIG. 19 as having displaced one corner protector 18 from its position of initial engagement into its position of final engagement.

As shown in FIG. 18, the inside surface 38 of one panel 30 of the corner protector 18 is disposed in close proximity to one vertical side 22 of the load 10 and is generally parallel to such side 22, in the position of initial engagement. Moreover, in the position of initial engagement, the inside surface 38 of the other panel 30 of the corner protector 18 faces the vertical side 24 meeting the vertical side 32 engaged thereby. When the corner protector 18 is displaced from the position of initial engagement into the position of final engagement, the corner protector 18 is displaced to such extent as may be then necessary to cause the inside surface 38 of the side panel 30 facing such side 24 to engage such side 24, generally in surface-to-surface engagement.

The mechanisms 140 comprise a pivotable structure 142 mounted pivotably in a manner to be later described, a rail structure 144 mounted pivotably on the pivotable structure 142, a retractable structure 146 mounted movably on the rail structure 144, and a pivotable fixture 148 mounted pivotably on the retractable structure 146.

The pivotable structure 142 is mounted pivotably on a fixed pedestal 160, via aligned upper and lower journals 162 (upper shown) so as to be pivotably movable over a limited range of pivotal motion. The pivotable structure 142 is shown at one extreme of such range in FIGS. 15 and 16 and at the other extreme of such range in FIGS. 17 and 18. The pivotable structure 142 includes a main beam 164 mounted pivotably on the journals 162 and a cross member 166 bolted to the main beam 164 and extended at a right angle relative to the main beam 164. A double-acting, pneumatic, piston-cylinder mechanism 168 is arranged to pivot the pivotable structure 142 relative to the fixed pedestal 160, between the extremes of such range.

The rail structure 144 comprises a pair of parallel rails 170 (see FIG. 3) having a common base 172, which is mounted pivotably on the cross member 166 of the pivotable structure 142, via a pivot pin 174 shown in phantom lines. A double-acting, pneumatic, piston cylinder mechanism 178 is arranged to pivot the rail structure 144 relative to the cross plate 166, over a limited range of pivotal motion. At one extreme of such range (see FIG. 15) the rail structure 144 is parallel to the cross member 166. At the other extreme thereof (see FIG. 177 the rail structure 144 defines a slight angle relative to the cross member 166.

The retractable structure 146 comprises a box beam 180, which is parallel to the rails 170 and which is mounted movably on the rails 170, via a pair of guide blocks 182 enabling the box beam 180 to move along the rails 170. The retractable structure 146 also comprises a supporting frame 184, which is bolted to the box beam 180, via a connecting structure 186, so as to extend at a right angle from one end of the box beam 180. A double-acting, pneumatic, piston-cylinder mechanism 188 is arranged to move the retractable structure 146 relative to the rail structure 144, between an advanced position and a retracted position.

The pivotable fixture 148 is mounted pivotably to the supporting frame 184 via aligned upper and lower journals 190 (one shown) so as to be pivotable between an inwardly pivoted position wherein the pivotable fixture 148 is pivoted inwardly (see FIG. 1 and FIGS. 16, 17, and 18) against the supporting frame 184 and an outwardly pivoted position wherein the pivotable fixture 148 is pivoted outwardly (see FIG. 15) from the supporting frame 184. A double-acting, pneumatic, rotary motor 200 (see FIG. 3) is arranged to pivot the pivotable fixture 148 relative to the supporting frame 184, between the inwardly pivoted and outwardly pivoted positions.

The pivotable fixture 148 comprises a gripping mechanism 210, which includes two similar, vertically spaced, vacuum-actuated, releasable grippers 212. Each gripper 212 has a retractable vacuum cup 214 of a known type, which is extended to make initial engagement with an elongate panel 30 of the endmost one of the corner protectors 18 in the magazine 40, after the escapement 110 has lifted the endmost corner protector 18 to the elevated position. The vacuum cup 214 is retracted after such engagement has been made, and after partial vacuum has been drawn through the vacuum cup 214 to grip such panel 30. The pivotable fixture 148 includes an elongate angle 220 extending vertically and generally between he grippers 212 and defining an elongate flange 222 extending vertically. The pivotable fixture 148 and associated grippers 212 of the gripping mechanism 210 of on of the apparatus 20 in the "left-hand" configuration are shown fragmentarily in FIG. 20.

The pivotable fixture 148 has a recess 230, which receives the corner protector panel 30 gripped by the vacuum cups 214, when the vacuum cups 214 are retracted. When the corner protector 18 having such panel 30 gripped thereby is transferred to the position of initial engagement, the pivotable fixture 148 may engage one vertical side 22 of the load 10. However, because such panel 30 is received by the recess 230, such panel 30 does not engage such side 22 but is disposed in close proximity to such side 22. The elongate flange 222 prevents the corner protector 18 from being pulled off the vacuum cups 214 accidentally when the corner protector 18 is being displaced from the position of initial engagement to the position of final engagement.

As shown sequentially in FIGS. 15 through 19, the mechanisms 140 are operated for removing one corner protector 18 from the magazine 40, transferring the corner protector 18 to the position of initial engagement, and displacing the corner protector 18 from the position of initial engagement to the position of final engagement.

Initially, the mechanisms 140 are positioned to enable the pneumatic motor 200 to pivot pivotable fixture 148 from its inwardly pivoted position into its outwardly pivoted position, in which the grippers 212 are positioned to engage the outside surface 36 of one elongate panel 30 of the endmost one of the corner protectors 18 in the magazine 40, after the escapement 110 has lifted the endmost corner protector 18 to the elevated position. Thus, as shown in FIG. 15, the pivotable structure 142 is positioned at one extreme of its limited range of pivotal motion. Also, the rail structure 144 is positioned parallel to the cross member 166, and the retractable structure 146 is positioned in its retracted position.

After the pivotable fixture 148 has been pivoted into the outwardly pivoted position the vacuum cups 214 are extended and vacuum pressure is drawn through the vacuum cups 214, which grip such panel 30 at its outside surface 96. Thereupon, as shown in FIG. 16, the pivotable fixture 148 is pivoted from the outwardly pivoted position into the inwardly pivoted position with the vacuum cups 214 gripping such panel 30, and the vacuum cups 214 are retracted.

After the vacuum cups 214 gripping such panel 30 have been retracted, the piston-cylinder mechanism 166 is used to pivot the pivotable structure 142 to the other extreme (see FIG. 17) of its limited range of pivotal motion. The rail structure 144, the retractable structure 146, and the pivotable fixture 148 are pivoted with the pivotable structure 142. Next, the rail structure 144 is pivoted so as to define a slight angle (see FIG. 17) relative to the cross member 166 of the pivotable structure 166.

Thereupon, the piston-cylinder mechanism 188 is used to move the retractable structure 146 from its retracted position into the advanced position Thus, as shown in FIG. 18, the corner protector 18 having one elongate panel 30 gripped at its outside surface 36 is moved to the position of initial engagement. The inside surface 38 of the panel 30 gripped thereby is disposed in close proximity to one vertical side 22 of the load 10. The inside surface 38 of the other panel 30 thereof faces the vertical side 24 meeting the vertical side 22 engaged thereby.

Thereupon, the piston-cylinder mechanism 178 is used to pivot the rail structure 144 toward and possibly beyond its position parallel with the cross member 166, as shown in FIG. 19, whereby the corner protector 18 having one elongate panel 30 gripped at its outside surface 36 is moved to the position of final engagement. Thus, such corner protector 18 is displaced, by translation without rotation, to such extent as may be then necessary to cause the inside surface 38 of the panel 30 facing the vertical side 24 of the load 10 to engage such side 24, generally in surface-to-surface engagement.

Figure 21:
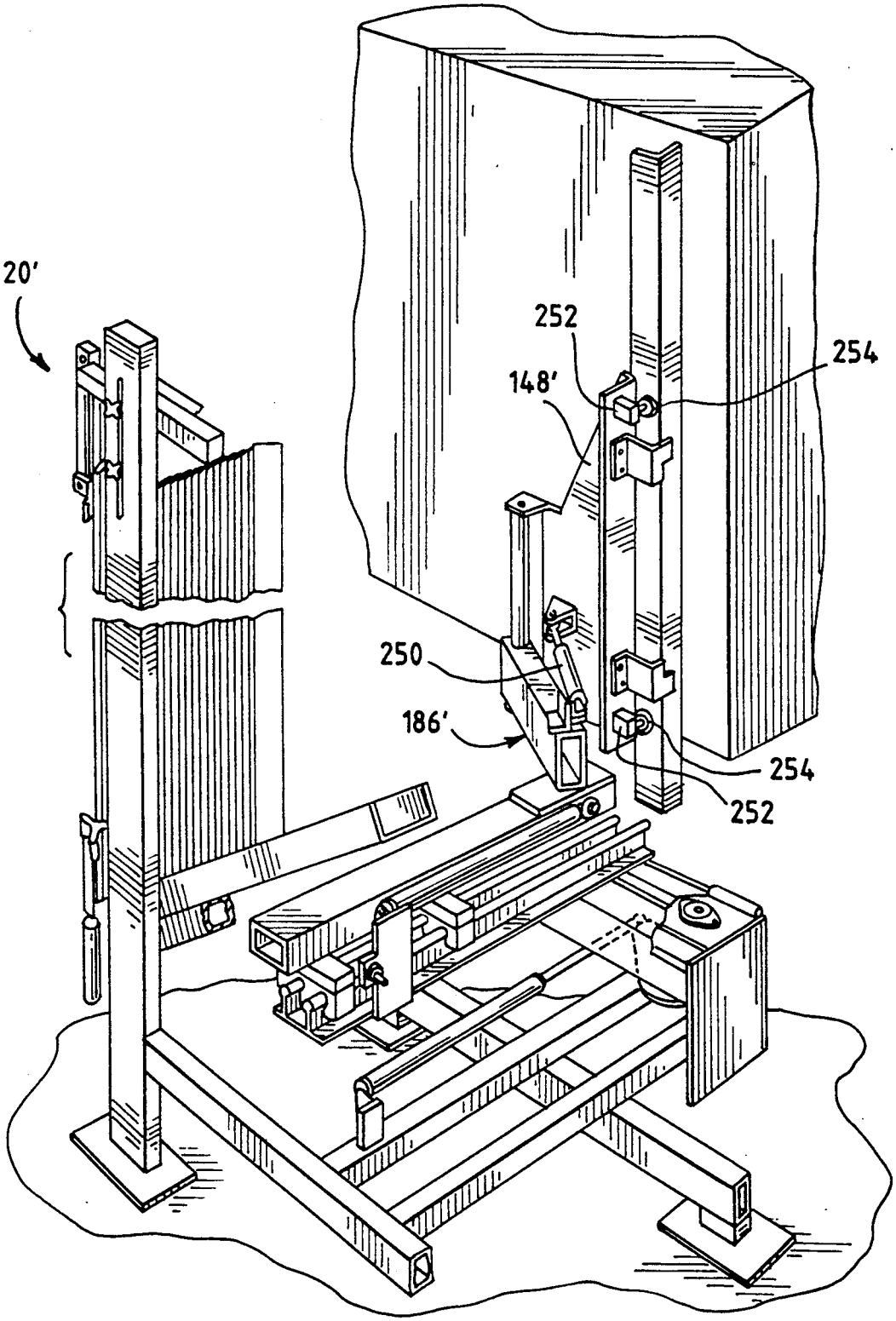
FIG. 21 is a fragmentary, perspective view of such an apparatus according to a second embodiment of this invention.

As shown in FIG. 21, in which primed reference numbers are used to designate elements designated by similar, unprimed reference numbers in the other views, an apparatus 20' for placing corner protectors onto palletized loads constitutes an alternative embodiment of this invention. The apparatus 20' is similar to the apparatus 20 and functions similarly, except that the connecting structure 186' is simpler than the connecting structure 186, that the pivotable fixture 148' is simpler than the pivotable fixture 148, that a double-acting, pneumatic, piston-cylinder mechanism 250 replaces the double-acting, pneumatic, rotary motor 200, and that the releasable grippers 252 are simpler than the releasable grippers 212, each releasable gripper 212 comprising a vacuum cup 254 of a known, more compact type.

Various other modifications may be made in the embodiments described above without departing from the scope and spirit of this invention.

I claim:

1. An apparatus for placing corner protectors onto loads having vertical sides meeting generally at right angles, each corner protector having two elongate panels meeting generally at a right angle to define an outside corner and an inside corner and each panel having an outside surface and an inside surface, the apparatus comprising a magazine adapted to hold a supply of the corner protectors, means for removing one corner protector from the magazine, means for transferring said one corner protector to a position of initial engagement where the inside surface of one panel of said one corner protector is disposed in close proximity to one vertical side of such a load, where said one panel is generally parallel with said one vertical side, and where the inside surface of the other panel of said one corner protector faces and is generally parallel with the vertical side meeting said one vertical side, and means for displacing said one corner protector from the position of initial engagement, by translating said one corner protector without rotating said one corner protector, to such extent as may be then necessary to cause the inside surface of the other panel of said one corner protector to engage the vertical side faced by said other panel.

2. The apparatus of claim 1 wherein the magazine constitutes means for holding the supply of corner protectors extending vertically and being nested within one another.

3. The apparatus of claim 2 wherein the means for removing, transferring, and displacing said one corner protector comprise means engageable releasably with the outside surface of said one panel for gripping said one corner protector as said one corner protector is removed, transferred, and displaced.

4. The apparatus of claim 3 wherein the gripping means comprises a pair of vacuum cups engageable releasably with the outside surface of said one panel of said one corner protector at vertically spaced locations so as to grip said one corner protector without stressing the panels of said one corner protector when said one corner protector is removed, transferred, and displaced.

5. The apparatus of claim 3 wherein the magazine comprises means for retaining the corner protectors held by the magazine and releasing said one corner protector from the magazine when said one corner protector is engaged by the gripping means.

6. The apparatus of claim 2 wherein the magazine comprises a chute inclined forwardly and downwardly toward an outlet end of the chute, the chute constituting means for supporting the supply of nested corner protectors with the outside corners facing forwardly and to guide the supported corner protectors forwardly toward the outlet end of the chute, and means for pressing against an endmost one of the corner protectors supported by the chute so as to prevent the corner protectors supported by the chute from tipping backwardly.

7. The apparatus of claim 6 wherein the pressing means comprises a wheeled carriage disposed movably within the chute, the wheeled carriage being adapted to move downwardly toward the corner protectors supported by the chute, the wheeled cart comprising an upright member for pressing against the endmost one of the corner protectors supported by the chute.

8. The apparatus of claim 6 wherein the magazine comprises means for elevating the corner protector nearest to the outlet end of the chute to an elevated position where the elevated corner protector is removed from the magazine.

9. An apparatus for placing corner protectors onto loads having vertical sides meeting generally at right angles, each corner protector having two elongate panels meeting generally at a right angle to define an outside corner and an inside corner and each panel having an outside surface and an inside surface, the apparatus comprising a magazine adapted to hold a supply of the corner protectors, means for removing one corner protector from the magazine, means for transferring said one corner protector to a position of initial engagement where the inside surface of one panel of said one corner protector is disposed in close proximity to one vertical side of such a load and where the inside surface of the other panel of said one corner protector faces the vertical side meeting said one vertical side, and means for displacing said one corner protector from the position of initial engagement to such extent as may be then necessary to cause the inside surface of the other panel of said one corner protector to engage the vertical side faced by said other panel, wherein the means for removing, transferring, and displacing said one corner protector comprise (a) a pivotable structure mounted so as to be pivotably movable over a limited range of pivotal motion,
(b) means for pivoting the pivotable structure between extremes of the limited range of pivotal motion,
(c) a rail structure mounted pivotably on the pivotable structure,
(d) means for pivoting the rail structure relative to the pivotable structure,
(e) a retractable structure mounted on the rail structure so as to permit movement of the retractable structure relative to the rail structure between an advanced position and a retractable position,
(f) means for moving the retractable structure relative to the rail structure between the advanced position and the retracted position,
(g) a pivotable fixture mounted on the retractable structure so as to be pivotably movable between an inwardly retracted position and an outwardly retracted position,
(h) means for pivoting the pivotable fixture between the inwardly retracted position and the outwardly retracted position, and
(i) means mounted operatively on the pivotable fixture for gripping a corner protector releasably at the outside surface of one panel of the corner protector.

10. The apparatus of claim 9 wherein the gripping means comprises a pair of vacuum cups arranged to grip a corner protector releasably at the outside surface of one panel of the corner protector.

* * * * *

UNITED STATES PATENT AND TRADEMARK OFFICE

CERTIFICATE OF CORRECTION

PATENT NO. : 5,226,280

DATED : July 13, 1993

INVENTOR(S) : Phillip G. Scherer and Werner K. Diehl

It is certified that error appears in the above-indentified patent and that said Letters Patent is hereby corrected as shown below:

Column 4, line 48, after "manner" insert --to be later described. A blade having a lower, saw- --.

Column 5, line 29, "14" should be --140--.

Column 6, line 61, "he" should be --the--.

Column 6, line 64, "on" should be --one--.

Signed and Sealed this

Twenty-ninth Day of March, 1994

*Attest:*

Bruce Lehman

BRUCE LEHMAN

*Attesting Officer*

*Commissioner of Patents and Trademarks*